United States Patent [19]

Leiter

[11] 4,366,924

[45] Jan. 4, 1983

[54] STAPLER HAVING AN ABUTMENT FOR LIMITING STAPLER REPENETRATION

[75] Inventor: Larry L. Leiter, Fairport, N.Y.

[73] Assignee: Xerox Corporation, Stamford, Conn.

[21] Appl. No.: 203,740

[22] Filed: Nov. 3, 1980

[51] Int. Cl.[3] ..... B25C 7/00

[52] U.S. Cl. ..... 227/155; 227/131

[58] Field of Search ..... 227/83, 131, 155

[56] References Cited

U.S. PATENT DOCUMENTS

| | | | |
|---|---|---|---|
| 2,957,174 | 10/1960 | Oussani | 227/131 |
| 3,524,575 | 8/1970 | Hurkmans et al. | 227/131 X |
| 4,315,589 | 2/1982 | Soong | 227/155 |

*Primary Examiner*—Gil Weidenfeld
*Assistant Examiner*—Fred A. Silverberg
*Attorney, Agent, or Firm*—Bernard A. Chiama

[57] ABSTRACT

A stapling apparatus is disclosed having an arrangement to prevent the repenetration of one or more legs of a staple during stapling of a low number of sheets, say on the order of 2, 3, 4, or 5 sheets while utilizing a staple of a size for 20 sheets or more. The invention is an improvement of a commercial machine which it modifies by adding a back up member to the staple deforming mechanism during penetration of the legs of the staple through sheets of paper and final bending of the legs in a stapling operation.

2 Claims, 7 Drawing Figures

STAPLER HAVING AN ABUTMENT FOR LIMITING STAPLER REPENETRATION

This invention relates to improvements in fastener applying apparatus for attaching sheets of paper. The present invention is particularly applicable to stapling devices, finishers and the like which are associated with copying machines having a finishing assembly which receives finished copy sheets in collated sets, are jogged and then stapled or stitched for use by an operator.

In conventional copy machines which employ staplers or finishing apparatus, problems have arisen when attempts are made to utilize the stapler or fixing device for copy sets which range from a two sheet set up to sets which include 30 or more sheets of paper. In commercial machines having stapling devices, use is made of various sizes of staples wherein staples with long legs are used for sets having a relatively large number of copy sheets, and short-legged staples are utilized for the lower range of the number of copy sheets. In between these two extremes of the number of sheets there may be other sizes of staples utilized. In these situations, the operator must either remove all of the staples from one or more of the staplers associated with the copying machine and insert quantities of staples of the size more compatible to the number of sheets in the set for which he is preparing to produce. This entails removing perhaps thousands of staples from each of the stapling devices associated with the machine and reinserting great quantities of the desired staple.

The alternative to incorporating procedures and apparatus for effecting staple size changes is to neglect or refrain making changes in staple sizes. In this situation, the machine utilizes a standard size staple, one having relatively long legs for the maximum number of sheets in a set the copy machine is adapted to collate. Generally, the combined length of both legs of the staple is greater than the length of the crown. When a copy machine utilizing a stapling apparatus having passive clinching devices is programmed then to produce sets containing 2, 3, 4, or 5 sheets and use is maintained for the long legged staples, the staples will re-penetrate such set during a stapling operation and the legs will protrude outwardly from the top sheet of the set thus presenting a very unsightly stapled set. In addition, with the two relatively sharp tips of the staple protruding through the top sheet there is great likelihood the recipient of a set will puncture the skin of his fingers in handling the set. Furthermore, when a number of sets having this condition of said staples are piled one upon the other such as in a file folder, the corner of the set having the staples becomes rather bulky and more than likely may even damage the edges of other papers in the file.

The present invention avoids the above discussed disadvantages by involving only the modification of presently commercial staplers, the Swingline Model 6800 Stapler, marketed by the Swingline Corporation of Long Island City, New York. While the improvement is directed to this particular apparatus, it will be understood that the invention is applicable to any manual or other automatic stapler having some of the common stapling structure of the 6800 Model. The improvement provides a means for redirecting one or both of the legs of a staple which would normally protrude back through sheets being stapled so that the leg(s) is restrained from assuming a direction of movement causing protrusion.

Another alternative, of course, is to utilize a relatively sophisticated active clinching device along with the stapler. These devices add considerable cost and complexity to a stapling apparatus and increases the incidences of malfunction.

Therefore, the principal object of the present invention is to improve stapling capability of a stapler device in handling thin sets of sheets, say on the order of two or three sheets, as well as thick sets, on the order of 20 or more sheets.

Another object of the invention is to improve the range of applicability of a stapling device without increasing its cost of manufacture or the necessity of providing sophisticated engineering techniques in developing an improvement to the device.

Further objects and advantages of the present invention are set forth or will appear from the following specification which describes a preferred form of the invention by way of example and is illustrated by the accompanying drawings wherein.

Figure 1:
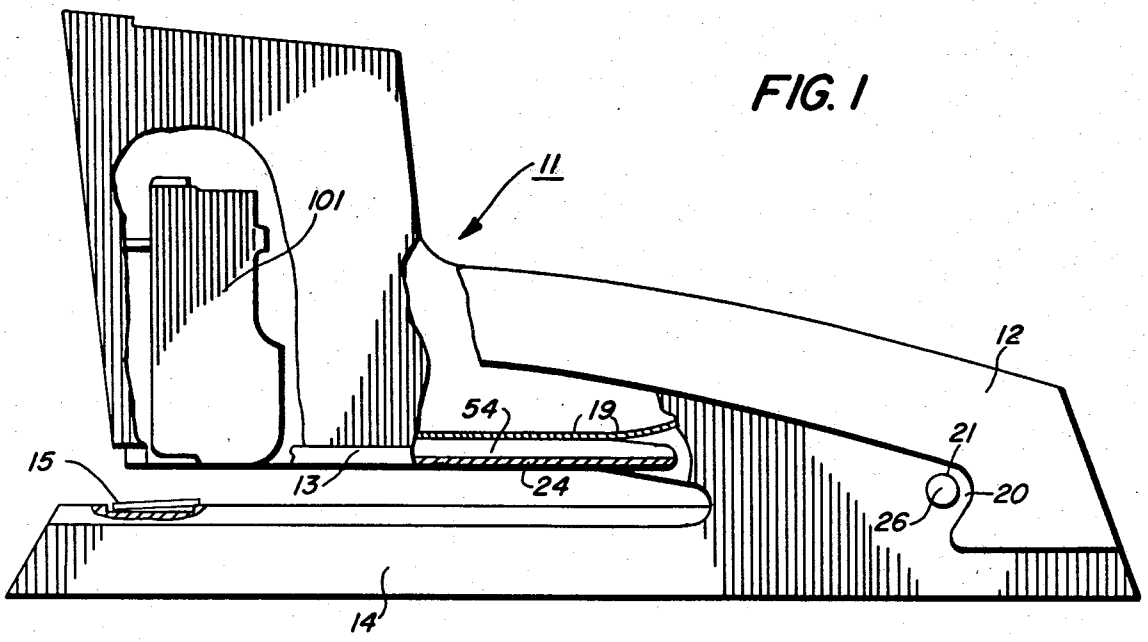
FIG. 1 is a side elevational view of a solenoid operable stapling apparatus embodying the principles of the present invention.

In the specification and accompanying drawings, the stapler apparatus disclosed for which the present invention is embodied for illustration purposes only, is a solenoid operated implement such as the commercial desk-type stapler sold in the market as the Swingline Model 6800. It is to be understood that this utilization is only for exemplary purposes and that the stapling apparatus of the present invention is also applicable to a sophisticated finishing stapler head utilized in conjunction with a copying machine.

The stapling apparatus illustrated herein, except for the improvement to which the invention is directed, is adequately disclosed in U.S. Pat. No. 3,524,575 assigned to the Swingline Corporation and the subject matter of this patent which is incorporated by reference herein. The apparatus is applicable to a ribbon form of packaging for staples, but any other commercial form may be utilized as long as the staple elements assume a U-shaped configuration when driven through sheets being stapled.

As disclosed in the above-referred to patent, the stapling apparatus 11 to which the present invention is embodied comprises a housing 12 containing a stapling head member 13 pivotally movable within the housing, and a base portion 14. The base 14 supports a passive clinching anvil 15 which is upwardly inclined at an angle substantially equal to the angle between the stapling head member 13 and the anvil when the stapling head abuts the anvil. The base 14 also houses a ribbon roll (not shown) of staple blanks comprising staple blanks 19.

The base 14 is formed with upstanding ears 20 having mating apertures 21 which are adapted to register with corresponding apertures formed in a lower control piston 24 of the stapling head 13 and in an upper control member 25. A pin 26 is disposed within all of the mating apertures to secure the housing 12 and stapling head member 13 to the base 14. The pin 26 also extends through the apertures formed to attach the control portion 24 and control member 25 to one another. A suitable spring (not shown) maintains the normal spaced relationship of the stapling head 13 to the anvil 15.

Lying within the lower control portion is a support rail 54 adapted to support the interconnected staple blanks 19 unrolled from their supply roll. On either side of the rail 54 are outwardly extending followers 63, 64. The followers 63, 64 are formed with downwardly formed portions 65, 66 respectively, which are adapted to abut the legs of a formed staple, as will be discussed hereinafter. Coil springs 67, 68 secured on one end to the followers 63, 64 respectively, and at their other end to a suitable anchor within the lower control portion 24 urge the respective followers forwardly.

Figure 2:
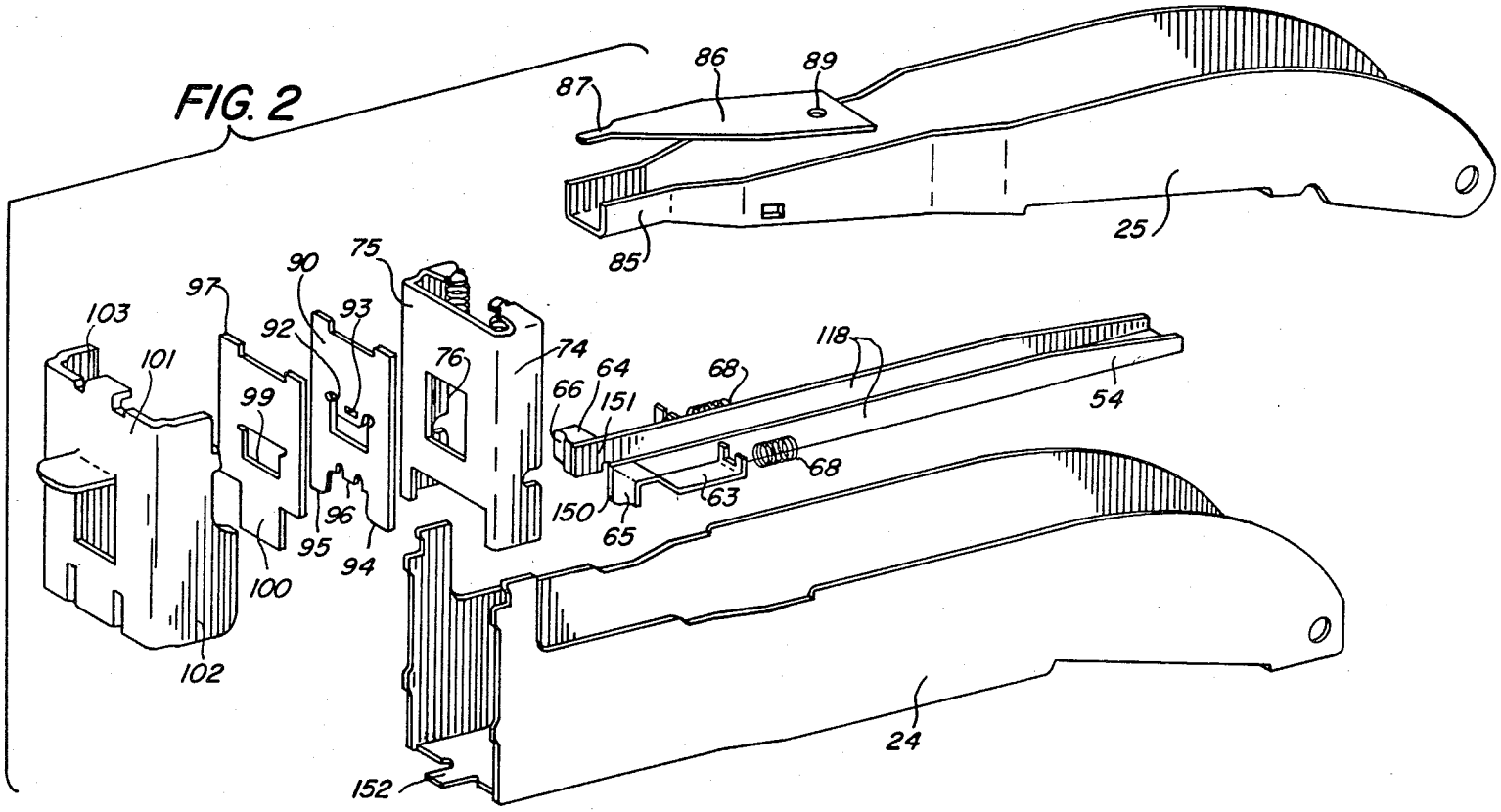
FIG. 2 is an exploded view of some of the components of the stapling head member shown in FIG. 1.

As shown in FIG. 2, the stapler is provided with a rear sheath 74 having a front face portion 75 formed with an aperture 76 therein. The sheath 74 is secured to the lower control portion 24 by any suitable means. The main upper control member 25 includes a forwardly projecting portion 85 and a leaf spring 86 formed with a forwardly projecting tang 87. The spring 86 is connected to the control member 25 by being in underlying relationship with respect to inwardly extending bosses formed on the member 25 and by upwardly extending extrusions 88 held within an opening 89 in the spring (see FIG. 3). When the stapler is fully assembled, the portions 85, 87 are contained within the recess 76 and project forwardly therefrom. In addition, the tang 87 of the spring 86 is retained within a slot 93 formed in the former 90.

The former 90 is also formed with an aperture 92 and spaced downwardly projecting portions 94, 95. Between these portions is an intermediate portion 96 which is of shallow arcuate configuration. Forward of the former 90 is a driver blade 97 which is formed with aperture 99 and a driving element 100. The portion 85 of the member 25 also extends through the aperture 92 in the former 90 and the aperture 99 in the driver blade. Forward of the driver blade 97 is a front sheath 101 which is formed with a pair of lateral, oppositely shaped extensions 102, 103.

Figure 4:
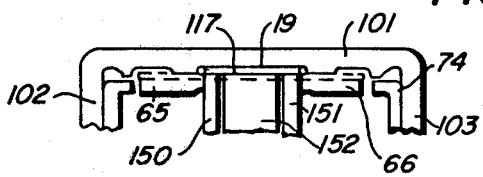
FIG. 4 is a cross sectional view of a detail.
Figure 3:
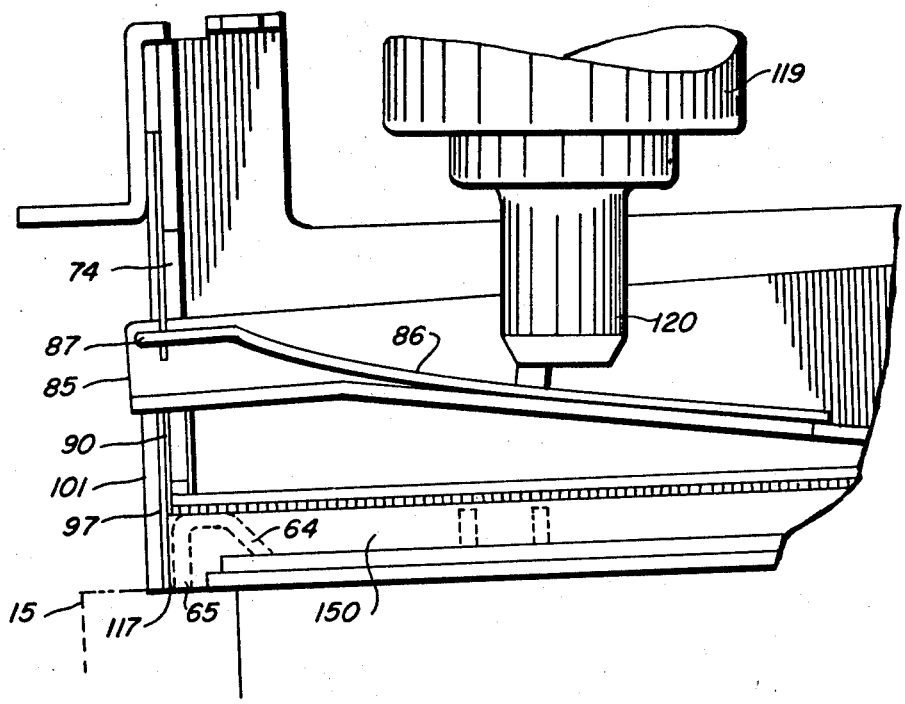
FIG. 3 is a detailed fragmentary cross sectional view of the stapling head in the position that it assumes in driving a staple.

Adjacent the driving element 100 of the driver blade 97 is a staple raceway 117 defined by the front end of the rail 54 and the sheath 101 (see FIGS. 3 and 4). The raceway 117 is of sufficient size to accommodate the crown portion of a formed staple but not the full length of an unformed staple element. The forward end of the rail 54 adjacent the former 90 constitutes inside forming means 118. The former 90 and the driver blade 97 are guided within a raceway formed between the sheath elements 74 and 101.

Figure 5:
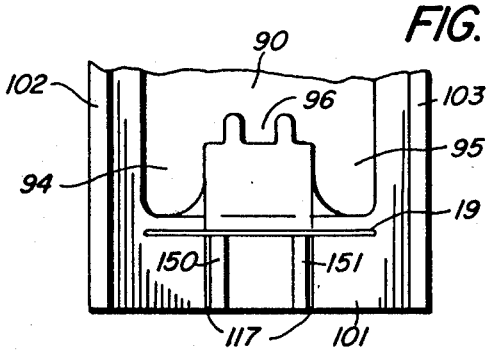
FIG. 5 is a front view of the former and driver utilized in the present invention.

For actuating the stapler in a stapling action, there is provided a solenoid 119 having a plunger 120 arranged to bear downwardly against the spring 86. A suitable circuit, not shown, is connected to the solenoid 119 to energize the same and may include one or more devices to control the energization upon demand of an operator. The structure described above and additional details are found in the above-cited U.S. Pat. No. 3,524,575. Only so much of this structure has been included herein that will be necessary to appreciate and understand the inventive improvement embodied in the present invention. In operation of the structure so far disclosed, the ribbon staple blanks 19 are adapted for advanced forward movement along the rail 54 to their forward position, as shown in FIG. 5.

Any one or a number of switches may be utilized to energize the solenoid 119 upon which occurrence the plunger 120 is driven downwardly to move the upper control portion 25 downwardly thereby driving the former 90 also in a downward direction. As the former 90 moves downwardly, the projecting portions 94, 95 engage and bend the legs of the staple and, as shown in FIG. 5, the bending occurs across the extreme forward end of the forming means 118. This staple is formed behind the raceway 117 and, until the staple is formed, it cannot pass into and through this raceway. On the other hand, as soon as the staple is so formed, its crown portion is now sufficiently short to pass into the raceway. As soon as this occurs, the followers 63 and 64 under force provided by the springs 68 push the legs of the staple involved into the raceway and thus move the entire belt 19 forwardly the diameter of one staple. On the next stroke, the element 100 of the driver blade 97 will drive this staple through the sheets being stapled.

The forming means 118 of the support rail 54 normally comprises upstanding walls 150, 151 between which is an open space. As will be discussed hereinafter, with this open space or void immediately behind a staple being formed and driven there is no back up or resistance to repenetration of at least one of the legs of a formed staple back through a set of sheets. By virtue of the present invention, an insert or integral piece is placed in this void to provide back-up support to a set being stapled so as to offer repenetration resistance as the front sheath 101 does for the staple legs. To this end, a plug member 152 is secured to the forward end of the lower control portion between the walls 150, 151 and extends forwardly to the extreme ends thereof. The lower surface of the member 152 has a surface coterminous with the lower edges of the walls 150, 151 so that all these surfaces contact the top surface of the anvil 15 as shown in FIG. 5. The forward surface of the member 152 forms the rear wall for the raceway 117.

Figure 6:
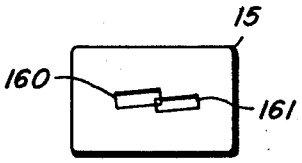
FIG. 6 is a plan view of an anvil with clinching grooves utilized in the present invention; and FIGS. *7a–7e* are schematic illustrations of a staple being operated upon during a stapling operation.
Figure 7:
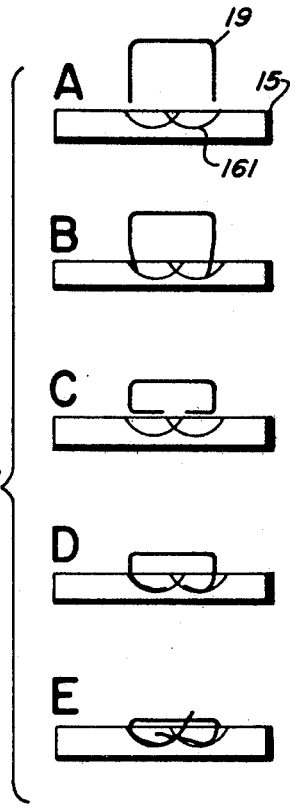
FIG.7 PRIOR ART

Before describing the operation of the present invention, a brief description of the manner in which the conventional stapler and anvil forms and driver staples will also be presented. In the anvil 15, as utilized in the above referred to commercial stapler, the clinching grooves 160, 161, as shown in FIGS. 6 and 7, have their longitudinal axis in parallel but at an angle relative to the bridge portion of a staple in order to prevent the tips of the legs of a staple from interferring with each other during a stapling operation.

In the commercial stapling apparatus mentioned above utilizing conventional clinching anvils, that is, the use of staples having relatively long legs for stapling sets of paper having only a few sheets such as 2, 3, 4, or 5, repenetration of one or more of the legs of the staple back through the top sheet of the set being stapled occurs. To avoid repenetration, the operator must remove the long legged staples in the stapling machine being utilized and add staples having short legs which may accommodate the low number of sheets being stapled without re-entry of the legs tips into the set. If later, the paper sets have a number of sheets, say on the order of 25 or more sheets, the operator must remove the short legged staples from the stapling apparatus and resupply the same with staples having long legs.

When the legs of the staple are pushed against the clinching grooves in the conventional anvil, deformation depends upon, besides the curvature of the grooves, the length of the legs measured from its tip to a support point along the leg.

In FIGS. 7*a* to 7*e*, there is shown various stages of a deformation of a staple during a stapling operation utilizing the conventional stapler mentioned above. In FIG. 7*a*, the staple has effectively penetrated a 2, 3, 4, or 5 sheet set and the tips are ready to engage the bottoms of the clinching grooves 160, 161. In FIG. 7*b*, the legs of the staple experience a plastic yield and become slightly deformed. In FIG. 7*c*, it is noted that further lowering of the staple provides a greater angular change in the legs. In FIG. 7*d*, it is noted that the shape of each of the legs conforms to the shape of the clinching grooves while the end portion of the legs remain fairly straight. In FIG. 7*e*, the tip of the left leg reenters the paper set to cause repenetration.

The present invention serves as a remedy to limit the increment of plastic deformation of the left leg at the stage illustrated in FIG. 7*e*. It has been found that repenetration occurs with only the left leg as viewed facing the front of the stapler. Due to the long leg length and the associated offset clinching grooves, the leg tip, after redirection forming in the anvil, is redirected to the rear of the stapler (behind the staple crown) and back up through the paper set. Without a backup to the paper set and the number of sheets being stapled is low, such as comprising 2, 3, 4, or 5 sheets, the leg tips repenetrate the set and protrudes through the top sheet of the set.

In order to eliminate their repenetration of the leg of the staple, the member 152 is provided within the void defined by the walls 150, 151. As shown in FIG. 5, the adjacent surface of the member 152 closes off the raceway 117. In this manner, the left leg of a staple will be prevented from repenetrating the paper set as the legs of the staple deform from the shape shown in FIG. 7*d* to the shape shown in FIG. 7*e*. The lower edge of the front sheath 101 offers resistance to the repenetration of the right leg of a staple and the member 152 offers resistance to the repenetration of the left leg.

From the foregoing, it will be appreciated that the present invention is an improvement of conventional staples which will permit the use of a single sized staple for stapling sets of paper sheets ranging between 2, 3, 4, or 5 sheets per set to sets containing 25 or more sheets. Such use envisions the prevention of the repenetration of one or more legs of a staple as being very undesirable in the high quality production of stapled copy sets. It will also be appreciated that this use of a single staple for a relatively wide range of thicknesses of paper sets to be stapled is readily available at very minimal cost both in parts and in engineering effort in modifying conventional stapling apparatus.

While the invention has been described with reference to the structure disclosed, it is not confined to the details set forth, but is intended to cover such modifications or changes as may come within the scope of the following claims.

I claim:

1. A stapling machine comprising a stapling head member and a base, said stapling head member being pivotally movable relative to said base, said stapling head member having a lower portion and a downwardly movable upper portion, said base having an anvil formed with clinching grooves, rails within said lower portion adapted to support a plurality of staple elements, a drive channel at one end of said rails, a staple driver blade movable within said drive channel by downward movement of said upper portion, a pair of movable follower members positioned on opposite sides of said rail and adapted to abut portions of the staple elements disposed upon said rails, said follower members forming a U-shaped staple during downward movement thereof and said driver blade driving legs of the U-shaped staple against said anvil thereby bending the legs during a stapling operation, and means positioned within and supported for pivotal movement with said rails and being adjacent said drive channel and arranged to resist bending of at least one of said legs of the staple beyond a predetermined limit during the stapling operation.

2. A stapling machine comprising a housing, a base connected to the housing having an anvil thereon, a stapling head member within said housing, said stapling head member including a pivotally movable support arm and a driving arm overlying said support arm and pivotally connected thereto, longitudinal rails for the support of a plurality of unformed staple blanks disposed within said support arm, a former blade and a driver blade connected with said driving arm, a front sheath normally covering said driver blade, a staple raceway within said front sheath accommodating said driver blade, said staple raceway being of a size sufficient to accommodate the crown of a formed staple but not an unformed staple, drive means adapted to actuate said driving arm and move the driving arm downwardly, said former blade forming a U-shaped staple during downward movement thereof and said driver blade driving legs of the U-shaped staple against said anvil thereby bending the legs during a stapling operation, and means positioned within and supported for pivotal movement with said rails and being adjacent said staple raceway and arranged to resist bending of at least one of said legs of the staple beyond a predetermined limit during the stapling operation.

* * * * *